US008905093B2

(12) United States Patent
Cloud et al.

(10) Patent No.: US 8,905,093 B2
(45) Date of Patent: Dec. 9, 2014

(54) AUTOMATIC RELEASING FUEL PUMP TRIGGER HOLDER

(75) Inventors: Mitzi G. Cloud, Atlanta, GA (US); Christopher Ginocchetti, Tampa, GA (US); Paul A. Kokesh, Tampa, FL (US); Robert G. Kokesh, Trenton, NJ (US)

(73) Assignee: Neoteric Vision, LLC, Wilmington, DE (US)

( * ) Notice: Subject to any disclaimer, the term of this patent is extended or adjusted under 35 U.S.C. 154(b) by 316 days.

(21) Appl. No.: 13/549,604

(22) Filed: Jul. 16, 2012

(65) Prior Publication Data

US 2014/0014860 A1 Jan. 16, 2014

(51) Int. Cl.
*G05G 5/06* (2006.01)

(52) U.S. Cl.
USPC ..... 141/392; 141/390; 248/304; 74/526

(58) Field of Classification Search
USPC ..... 141/390, 392; 248/304; 74/526
See application file for complete search history.

(56) References Cited

U.S. PATENT DOCUMENTS

| | | | | | |
|---|---|---|---|---|---|
| 4,176,695 | A | | 12/1979 | Raske | |
| 4,236,552 | A | * | 12/1980 | Rayboy | 141/98 |
| 4,287,736 | A | * | 9/1981 | Hadgis | 70/458 |
| 4,337,917 | A | * | 7/1982 | Tesack et al. | 251/90 |
| 4,497,350 | A | | 2/1985 | Guertin | |
| 4,683,923 | A | | 8/1987 | Harris | |
| 4,690,182 | A | * | 9/1987 | Knaus | 141/392 |
| D298,212 | S | * | 10/1988 | Gross | D8/349 |
| 4,846,447 | A | | 7/1989 | Hanna | |
| 5,118,074 | A | | 6/1992 | Weissman | |
| D362,612 | S | * | 9/1995 | Will | D8/354 |
| 5,487,418 | A | * | 1/1996 | Reyes | 141/392 |
| 5,517,732 | A | * | 5/1996 | Crear | 24/299 |
| 6,095,173 | A | * | 8/2000 | Perry | 141/392 |
| 6,273,157 | B1 | * | 8/2001 | Molnar | 141/392 |
| 6,418,988 | B1 | * | 7/2002 | Palumbo et al. | 141/392 |
| 6,830,086 | B2 | * | 12/2004 | Smith et al. | 141/392 |
| D508,841 | S | * | 8/2005 | Jordan, Jr. | D8/395 |
| D569,241 | S | * | 5/2008 | O'Neill | D8/395 |
| D667,629 | S | * | 9/2012 | Alamo | D3/210 |
| 8,376,001 | B1 | * | 2/2013 | Wallauer | 141/392 |
| 2003/0168121 | A1 | * | 9/2003 | Smith et al. | 141/392 |
| 2006/0185765 | A1 | * | 8/2006 | Bates, III | 141/392 |

* cited by examiner

*Primary Examiner* — Nicolas A Arnett
(74) *Attorney, Agent, or Firm* — Tracy Jong Law Firm; Tracy P. Jong; Cheng Ning Jong

(57) ABSTRACT

A fuel pump trigger holder for holding the trigger of a fuel pump in an open position, where the fuel pump includes a handle against which the trigger is squeezed to allow fuel flow. The holder comprises a pair of prongs extending from an elongated base and ending at a pair of endpoints, wherein a top prong of the pair of prongs comprises a curved portion extending from the base and curving towards a bottom prong of the pair of prongs which extends at an incline relative to the base. The pair of prongs is configured for being disposed around the trigger and the handle for maintaining the trigger in a position corresponding to a fuel pump open position and releasing the trigger such that it returns to a closed position upon detecting a kicking motion from the fuel pump indicating a full fuel condition.

19 Claims, 6 Drawing Sheets

AUTOMATIC RELEASING FUEL PUMP TRIGGER HOLDER

BACKGROUND OF THE INVENTION

1. The Field of the Invention

The present invention is directed generally to a fuel pump trigger holder, and more particularly, to a holder capable of retaining a fuel pump trigger in an open position and releasing the trigger to return to its closed position when the fuel pump detects a full fuel condition.

2. Background Art

Many fuel dispenser or pump handles are provided with a mechanism which permits the trigger to be locked in one of several levels of open positions. This allows the person filling the tank to attend to other duties such as cleaning the windows while the vehicle is being filled with fuel. In some occasions, built-in fuel pump trigger holders have been removed for safety reasons (spills, for example) due in large part to relatively few defective or improperly designed fuel pump triggers. As a result, a user is required to attend to the task of fueling during the entire period during which his or her vehicle is being fueled, as it is expected that the user would be able to respond to any malfunctions of the fuel pump trigger to prevent potential disaster. In addition to the obvious inconvenience, recent studies indicate that exposure to petroleum and petroleum fumes can cause negative health effects. Prolonged contact with gas pump surfaces can also cause transmission of bacteria and viruses.

A fuel dispenser or pump generally includes a handle that is fluidly and structurally connected to a spout, a lever or trigger operably connected to a valve for controlling fuel flow through the spout and positioned such that the palm of a hand positioned on the handle is capable of reaching and squeezing the trigger towards the handle. There is typically further a guard disposed around the trigger to protect the dispenser from accidental squeeze of the trigger or accidental dispensing of fuel. In response to the need disclosed earlier, there have been numerous devices developed in the related art which are adapted to hold the trigger in an open position so that a person pumping fuel does not have to hold the handle and continually apply manual pressure to the trigger.

Various portable devices including many types of locks, holders, latches or clamps have been devised for holding the valve of a fuel pump open. Some of these devices include "stair steps" or jagged edges configured to hold a trigger in place at various levels of trigger hold or fuel flow. There are two general types of fuel pump trigger holders. The first type includes a "C" shaped structure used to limit movement of the trigger relative to the handle. In some instances, the structure may appear as rings composed of a single or multiple segments. The second type includes an "I" shaped structure configured to be disposed between a trigger and its guard to limit movement of the trigger relative to the guard. Most of these devices are capable of attachment to a secondary item, such as a key chain, key or another attachment, such as the holder disclosed in U.S. Pat. No. 5,118,074 to Weissman (hereinafter Weissman). None of the prior art devices includes an automatic release mechanism which can automatically release the trigger upon detecting a full fuel condition.

In prior art devices, termination of fueling is made possible only by a sensing and actuating mechanism disposed inside a fuel pump nozzle. A fuel pump nozzle comprises a sensing port that is used to detect when the fuel tank is full, and hence to stop supplying fuel. This is achieved by applying a vacuum to sensing port; when fuel travels into the sensing port, fuel supply is cut off, thereby creating a kicking motion as the fuel flow is abruptly terminated. The fuel pump however is still held in an open position until the trigger is released. The capability of automatically releasing the trigger with a portable holder is a feature not available in prior art portable holders. Reference is made to U.S. Pat. No. 4,497,350 to Guertin in connection with the means by which this kicking motion is created.

Weissman discloses a device for holding a lever of a fuel pump in at least two adjusted, open positions in accordance with a desired rate of flow of fuel from a nozzle. The device includes a hook-shaped arm structured to hang over a top surface of the gas pump handle so as to be supportably engaged. A number of parallel fingers extending outwardly from an elongate portion at spaced intervals from the hook-shaped arm, each of the fingers adapted to supportably receive the lever in one of the adjusted, open positions. The device can be carried on a key ring fitted through an aperture therein. This device uses a number of fingers to provide different levels of fuel flow and not capable of continuous modulation of fuel flow. This device further lacks an automatic trigger release feature for receiving the kicking motion of a fuel pump.

U.S. Pat. No. 4,846,447 to Hanna discloses an actuator device for a trigger operable within a housing of an automatic nozzle of a gasoline pump and consists of a pair of jaws, each formed transversely onto an opposite end of a web of a predetermined length. The upper jaw fits over the housing while the lower jaw fits under the trigger when the trigger is pulled up for operation. Although a leaf spring is utilized in contacting engagement with a trigger, it is neither configured to hold the trigger at varying degrees of squeeze nor does it permit automatic disengagement of the trigger when a full fuel condition has been detected.

U.S. Pat. No. 4,176,695 to Raske discloses a device for holding the lever of a nozzle assembly in a position to open a valve, controlling the flow of fuel through a passageway in the handle of the assembly. The capability of automatically releasing the trigger of a fuel pump is also not contemplated in this device.

U.S. Pat. No. 4,683,923 to Harris discloses a clip for holding the lever of a gasoline pump dispensing handle in open gasoline dispensing position. The clip is made from a single flat plate of uniform thickness having a rear shank about 1½ inches in length with a pair of identical arms extending about 1½ inches from the opposite ends of the shank and forming between the arms an angle of approximately 40 degrees. A serrated row of similar flat-topped teeth lies along the inner edge of each arm with the flat tops of each serrated row of teeth lying in a common plane and the two planes containing the flat tops intersecting each other at an angle of approximately 40 degrees. The capability of automatically releasing a fuel pump trigger is also not contemplated in this device.

Thus, there exists a need for a holder configured to hold a fuel pump trigger corresponding to an open position and automatically release the fuel pump trigger upon detection of a full fuel condition in the tank which the fuel pump is designed to fill.

SUMMARY OF THE INVENTION

The present invention discloses a fuel pump trigger holder for holding a fuel pump which includes a handle and a trigger, in an open position. In this open position, the trigger is pulled towards the handle and the present holder is configured to hold the handle in this position until a full fuel condition is detected. The fuel pump trigger holder comprises an elongated base, a bottom prong extending from a first end of the base at an incline with respect to the base, to a bottom endpoint and a top prong extending from a second end of the base and terminating at a top endpoint toward the bottom prong in a curved portion. The top and bottom prongs define an opening configured for limiting the distance between the trigger and the handle such that the fuel pump trigger is held in a position corresponding to an open position of the fuel pump. In one embodiment, the top prong further comprises an olecranon extending from the top endpoint. In use, in order to hold the fuel pump in an open position, the handle and the trigger disposed in a desired position is slid into an engagement area defined by the top prong, olecranon, base and the bottom prong such that the top prong or top prong and olecranon combination hangs over the handle while the trigger is held in place by the bottom prong.

In one embodiment, the holder further comprises a protrusion extending from the base in a direction away from the top and bottom prongs, wherein the protrusion is configured as hand grip for the holder.

In one embodiment, the incline is disposed at an angle of from about 69 to about 85 degrees with respect to the base. The surface of bottom prong facing the top prong is preferably composed of a ribbed surface and configured to retain the trigger in an open position and release the trigger from the open position when a kicking motion is detected. The distance between the top endpoint and bottom endpoint is about 1.4 inches.

In one embodiment, a blister is provided and disposed at the bottom endpoint. The blister is configured to cooperate with the surface facing the top prong to retain the trigger in an open position and release the trigger from the open position when a kicking motion is detected.

In order to facilitate stowage of the present holder, a holster is configured for receiving the bottom prong, wherein the holster is adapted to be affixed to the vicinity of a fuel filler within which a fuel pump is to be used.

It is a primary object of the present invention to provide a fuel pump trigger holder capable of automatic release from a fuel pump trigger which creates a kicking motion when the fuel flow through it is abruptly terminated.

It is a further object of the present invention to provide a multiple position fuel pump trigger holder which is relatively compact in size so that it does not interfere with any structure surrounding any fuel filler and is also adapted to be seated within the cavity surrounding any fuel filler enclosure so as to be readily available when needed.

It is another object of the present invention to provide a fuel pump trigger holder which is adapted for use with virtually all gas pump handles where the fuel flowrate can be adjusted.

It is yet another object of the present invention to provide a fuel pump trigger holder which is relatively simple in operation and manufacturing methods and inexpensive to fabricate, thereby reducing the cost to the consuming public.

Whereas there may be many embodiments of the present invention, each embodiment may meet one or more of the foregoing recited objects in any combination. It is not intended that each embodiment will necessarily meet each objective. Thus, having broadly outlined the more important features of the present invention in order that the detailed description thereof may be better understood, and that the present contribution to the art may be better appreciated, there are, of course, additional features of the present invention that will be described herein and will form a part of the subject matter of this specification.

In this respect, before explaining at least one embodiment of the invention in detail, it is to be understood that the invention is not limited in its application to the details of construction and the arrangements of the components set forth in the following description or illustrated in the drawings. The present invention is capable of other embodiments and of being practiced and carried out in various ways. Also it is to be understood that the phraseology and terminology employed herein are for the purpose of description and should not be regarded as limiting.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

PARTS LIST

2—automatic releasing fuel pump trigger holder
4—top prong
6—olecranon
8—bottom prong
10—protrusion
12—elongated base

14—pump handle
16—pump trigger
18—length of top prong
20—height of bottom prong
22—width of opening between olecranon and bottom prong
24—extremity of protrusion
26—angle between bottom prong and base
28—length of third prong
30—height of device
32—width of olecranon
34—distance between pump handle and trigger
36—hand
38—holster
40—plate
42—pocket
44—blister
46—trigger pivot
48—direction
50—spout
52—fuel filler of fuel tank
54—direction
56—ribbed surface
58—opening
60—fuel filler door

PARTICULAR ADVANTAGES OF THE INVENTION

In contrast to Weissman, the present holder allows a fuel pump trigger to be held in any position within the range of positions corresponding to open and closed positions of the fuel pump. Weissman uses a number of fingers to provide different levels of fuel flow while the present device uses one prong, i.e., the bottom prong disposed at a slant or incline to provide varying levels of fuel trigger position while enabling the automatic release of the trigger upon receiving a kicking motion from the fuel pump.

The present holder further includes an olecranon extending from the top prong to provide enhanced securement of the top prong to a fuel pump handle and prevent accidental detachment of the present holder from the fuel pump handle. In one embodiment, a blister is provided and disposed at the free end or endpoint of the bottom prong, the blister is configured for cooperation with a bottom prong surface facing the top prong and an olecranon disposed on the top prong to secure the fuel pump trigger in a stationary position corresponding to a fuel pump open position while fueling occurs and release the fuel pump trigger from the open position when a kicking motion of the fuel pump is detected. In another aspect, instead of using a blister to retain the fuel pump trigger, the bottom prong surface facing the top prong is ribbed to provide sufficient grip of the trigger while fueling and yet capable of releasing the trigger when a kicking motion of the fuel pump is detected.

DETAILED DESCRIPTION OF A PREFERRED EMBODIMENT

The term "about" is used herein to mean approximately, roughly, around, or in the region of. When the term "about" is used in conjunction with a numerical range, it modifies that range by extending the boundaries above and below the numerical values set forth. In general, the term "about" is used herein to modify a numerical value above and below the stated value by a variance of 20 percent up or down (higher or lower).

Figure 1:
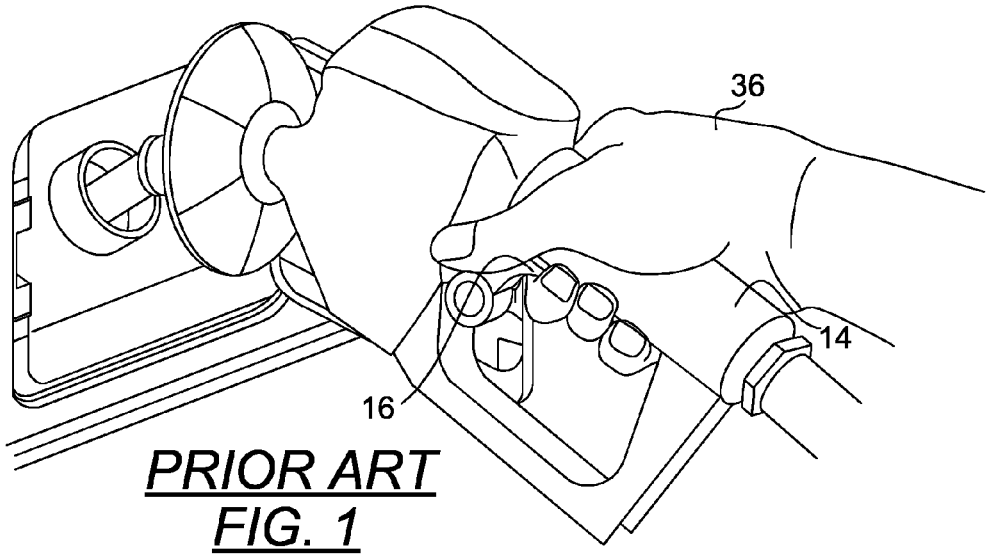
PRIOR ART FIG. 1
FIG. 1 is a top perspective view of a fuel pump being used in a conventional manner.
Figure 2:
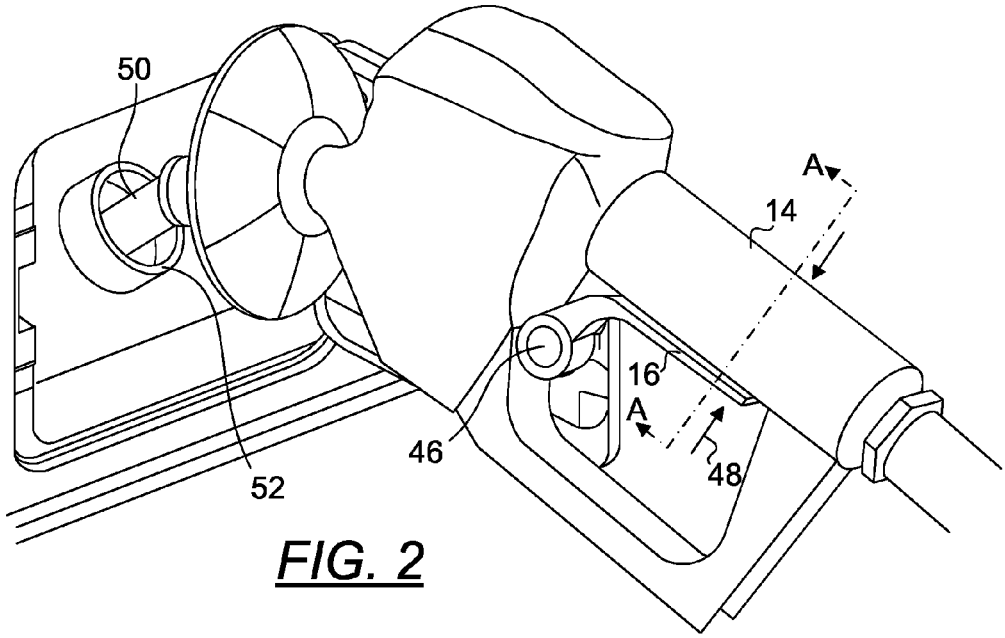
FIG. 2 is a top perspective view of a fuel pump depicting a desired position of the trigger to cause flow through the fuel pump.

FIG. 1 is a top perspective view of a fuel pump being used in a conventional manner. FIG. 2 is a top perspective view of a fuel pump depicting a desired position of the trigger to cause flow through the fuel pump. The trigger 16 is rotatably connected to the pump handle 14 about pivot 46 and normally disposed in a position away from the pump handle 14 while the fuel pump is not in use. A typical fuel pump (such as the one disclosed in FIGS. 1 and 2) comprises a spout 50, a handle 14, a flow control device adapted to the fuel pump at handle 14, a vapor sensor recovery system and a trigger 16 operably and pivotably connected to the flow control device. In use, a hand 36 is placed around the handle 14 for grasping the fuel pump and the spout 50 is inserted into the fuel filler 52 of a fuel tank. The trigger 16 is then pulled toward the handle 14 in direction 48 by hand 36 and maintained in such position to cause a flow through the pump handle 14 and spout 50 into the fuel tank. For a fuel pump lacking a built-in trigger holder, this flow position is maintained by hand 36 throughout the entire filling period of the fuel tank. Upon detecting a full fuel condition, a kicking motion is created in fuel pump handle. A fuel pump equipped with a built-in trigger holder would receive such kicking motion and dislodge the built-in trigger holder, thereby allowing the trigger to return to a position corresponding to zero flow through the fuel pump. The present holder 2 replaces the function of such a built-in trigger holder.

Figure 3:
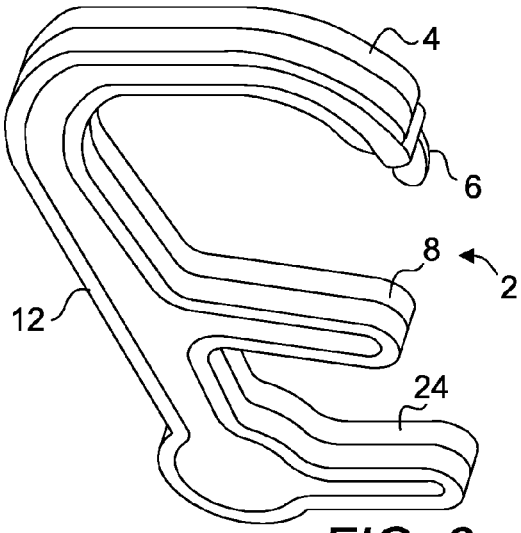
FIG. 3 is a top perspective view of one embodiment of the present holder.
Figure 4:
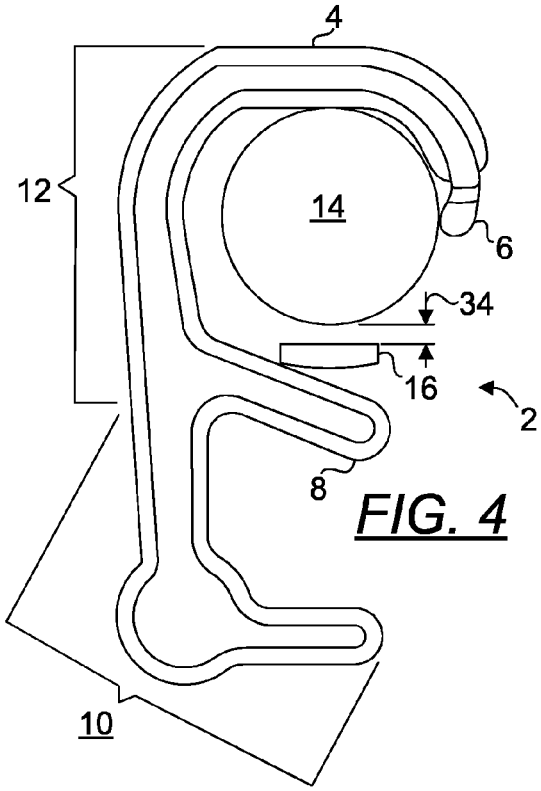
FIG. 4 is a side orthogonal view of the holder of FIG. 3, depicting its use on a fuel pump as taken along line A-A of FIG. 2.

FIG. 3 is a top perspective view of one embodiment of the present holder 2. The holder 2 comprises a pair of prongs 4, 8 extending from an elongated base 12 and ending at a pair of endpoints. The top prong 4 of the pair of prongs 4, 8 comprises a curved portion extending from the base 12 and curving towards a bottom prong 8 of the pair of prongs 4, 8. The bottom prong 8 extends at an incline relative to the base 12. The pair of prongs is configured for being disposed around the trigger 16 and handle 14 for maintaining the trigger 16 in a position corresponding to a fuel pump open position as shown in FIG. 4. FIG. 4 is a side orthogonal view of the holder 2 of FIG. 3, depicting its use on a cross-sectional view of a fuel pump as taken along line A-A of FIG. 2. The holder 2 further comprises a protrusion 10 extending from the base 12 in a direction away from the pair of prongs 4, 8, wherein the protrusion 10 is configured as a hand grip for the holder 2. Although not a requirement, the protrusion generally extends from one end of the base 12 in substantially the same axial direction as the base 12 before diverging substantially at right angle into a third prong to extremity 24. The length 28 of the third prong preferably measures about 1.2 inches.

Figure 5:
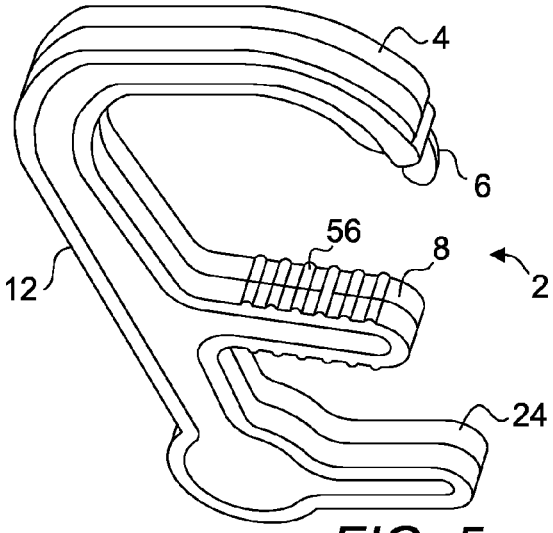
FIG. 5 is a top perspective view of another embodiment of the present holder.
Figure 6:
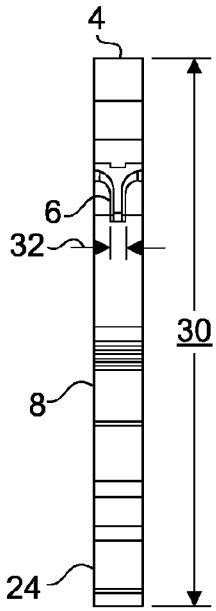
FIG. 6 is a front orthogonal view of the embodiment of FIG. 5.
Figure 7:
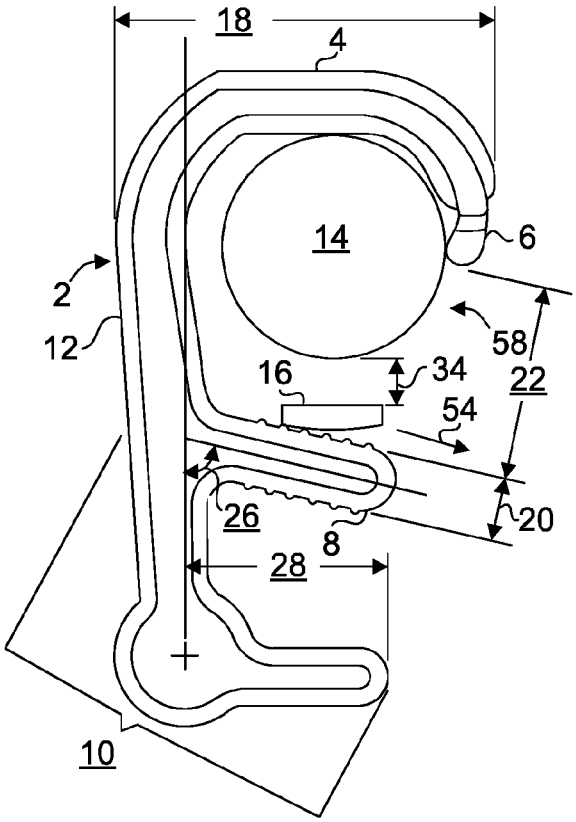
FIG. 7 is a side orthogonal view of the holder of FIG. 5, depicting its use on a fuel pump as taken along line A-A of FIG. 2.

FIGS. 5 and 6 are top perspective and front orthogonal views, respectively, of another embodiment of the present holder 2. FIG. 7 is a side orthogonal view of the holder of FIG. 5, depicting its use on a fuel pump as taken along line A-A of FIG. 2. The holder 2 of FIG. 5 is essentially the same as the holder 2 of FIG. 3 with the exception that the bottom prong 8 includes a ribbed surface 56 on a surface facing the top prong 4. The holder further comprises an olecranon 6 extending from the top prong. In one embodiment, the incline 26 is disposed at an angle of from about 69 degrees to about 85 degrees relative to the base 12. The term "olecranon" is used as it mimics an eminence from a structure. The length 18 of the top prong 4 of about 2.1 inches, olecranon 6, base 12 and the length and incline of the bottom prong 8 together define an engagement area and an opening 22 of about 1.2 inches for receiving the handle 14 and trigger 16 of a fuel pump. In one embodiment, the olecranon 6 is constructed from a non-skid polymeric material capable of being deformed when the handle 14 is forced through the opening into and out of the engagement area. In one embodiment, the height 20 of the bottom prong 8 measures about 0.3 inches. The height 30 of the holder 2 measures about 3.6 inches. The width 32 of the olecranon 6 measures about ⅛ inch.

Figure 8:
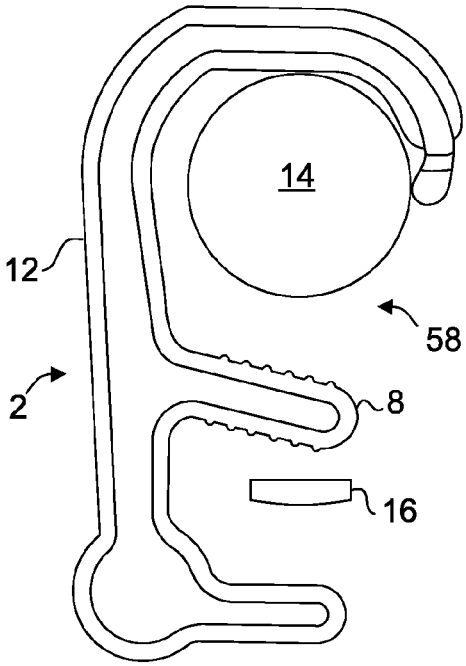
FIG. 8 is a side orthogonal view of the holder of FIG. 7, depicting the holder having been dislodged from a pump handle.
Figure 9:
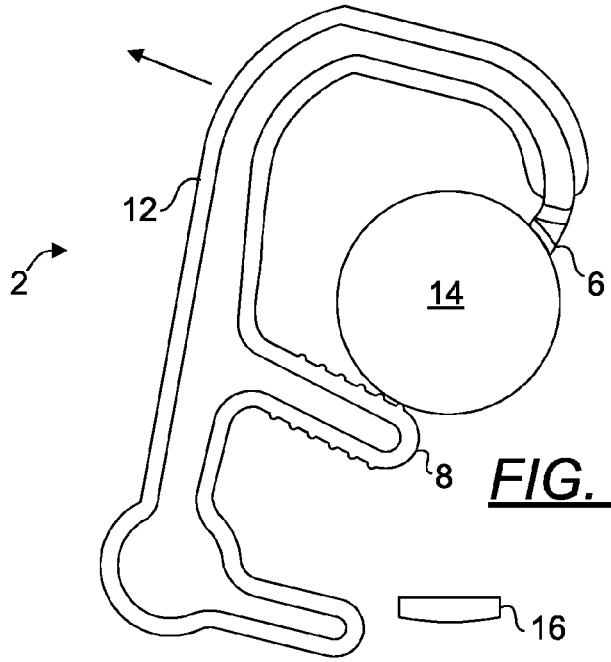
FIG. 9 is a side orthogonal view of the holder of FIG. 7, depicting the holder being removed from the pump handle.

FIGS. 8-11 depict interactions of a fuel pump with a present holder 2. FIG. 8 is a side orthogonal view of the holder of FIG. 7, depicting a holder having been dislodged from a pump handle. FIG. 9 is a side orthogonal view of the holder of FIG. 7, depicting the device being removed from the pump handle. Upon receiving a kicking motion from the fuel pump due to a full fuel condition in a fuel tank into which the fuel pump is inserted, the trigger 16 slides along direction 54 on the upper surface (surface facing top prong 4) and eventually disengages from this surface and the trigger 16 returns to a position corresponding to a zero flow condition as shown in FIG. 8. It shall be noted that in contrast to prior art holders lacking such an incline, the present holder enables automatic release of the trigger 16 to an eventual position corresponding to zero flow in the fuel pump upon receiving the kicking motion of the fuel pump. By disposing the bottom prong at an incline, continuously varying levels of trigger position are also possible. Most fuel pumps are capable of modulating fuel flow rate through them with the handle 14 and trigger 16 of FIG. 7 depicting an example of such pumps. The distance 34 between the trigger 16 and the handle 14 therefore corresponds to the degree of squeeze of the trigger 16 against the handle 14 or fuel flow rate through the handle 14.

In use, trigger 16 is first squeezed to a desired position. The handle and trigger pair is then disposed in the engagement area such that the tendency of the pair to spread to return to the zero flow condition in the fuel pump is constrained by the top prong 4 or the top prong 4 and olecranon 6 combination at the handle 14 and the bottom prong 8 at the trigger 16. When fueling is complete and in order to remove the holder 2 from the handle 14, the holder 2 is simply pulled in a direction away from the handle 14 through opening 58. Certain pump handle configurations may not fit through the opening 56 without deforming the olecranon 6. In such a pump handle, as demonstrated in FIG. 9, the handle 14 may be forced through the opening 58 and thus deforming the olecranon 6 slightly but without undue force due to the suitably configured olecranon width 32. Such olecranon 6 arrangement further secures the holder 2 to the pump handle 14 when the fuel pump is maintained in the open condition (or the trigger is squeezed) or when the trigger has disengaged from the bottom prong 8.

Figure 10:
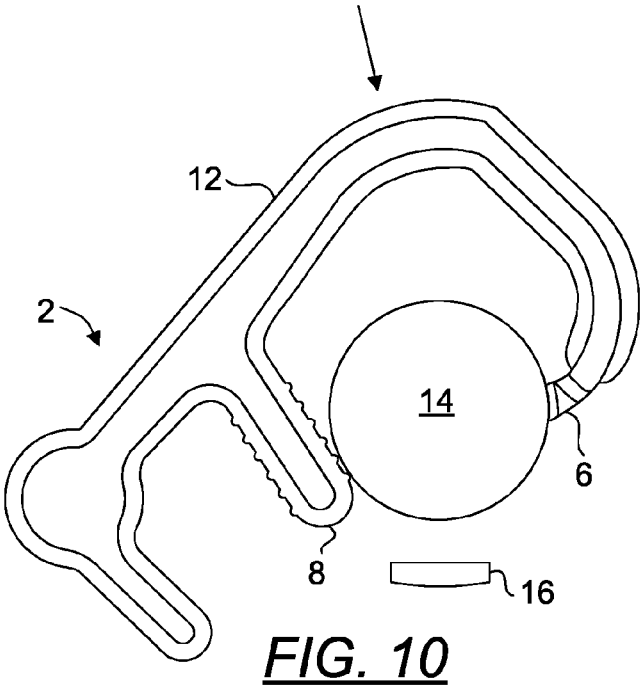
FIGS. 10-11 are side orthogonal views of the holder of FIG. 7, depicting the steps taken to hold the trigger in a position corresponding to a fuel pump open position.
Figure 11:
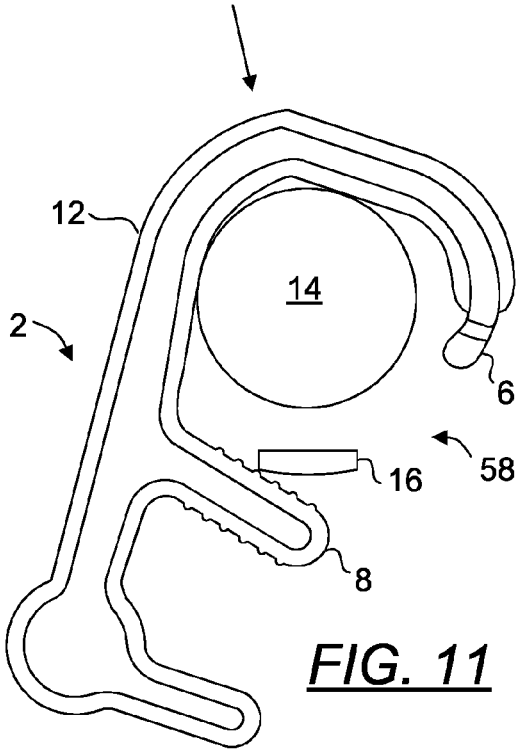

FIGS. 10-11 are side orthogonal views of the holder of FIG. 7, depicting the steps taken to hold the trigger in a position corresponding to a fuel pump open position. The handle 14 is first forced through the opening 58 into the engagement area. The trigger 16 is then squeezed with a squeeze such that the handle 14 and trigger 16 can fit into the engagement area. The squeeze is then relaxed such that the handle 14 and trigger 16 pair has the tendency to spread (or return to a trigger position corresponding to the fuel pump closed position) with the handle 14 contacting a surface of the top prong 4 which faces the bottom prong 8 and the trigger 16 contacting a surface of the bottom prong 8 which faces the top prong 4. As used herein, a ribbed surface represents a surface having tread-like patterns, ridges, raised bumps, etc, and constructed from a suitable polymeric material capable of retarding sliding motion of the trigger 16, whose capability is overcome only by a kicking motion resulted from a full fuel condition of a fuel pump.

Figure 12:
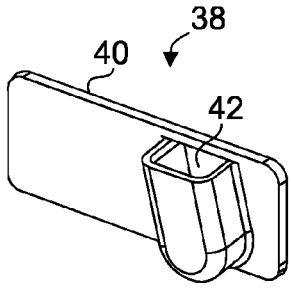
FIG. 12 is a top perspective view of a holster configured for securing a present holder.
Figure 13:
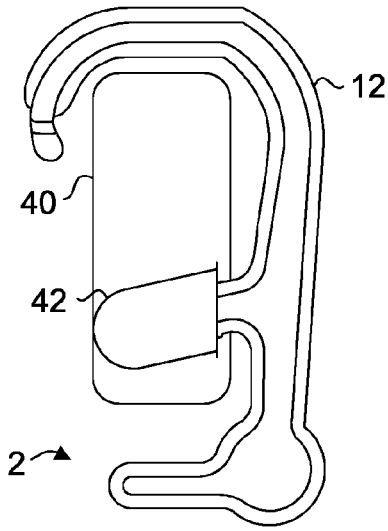
FIG. 13 is a side orthogonal view of a present holder being secured in a holster.
Figure 14:
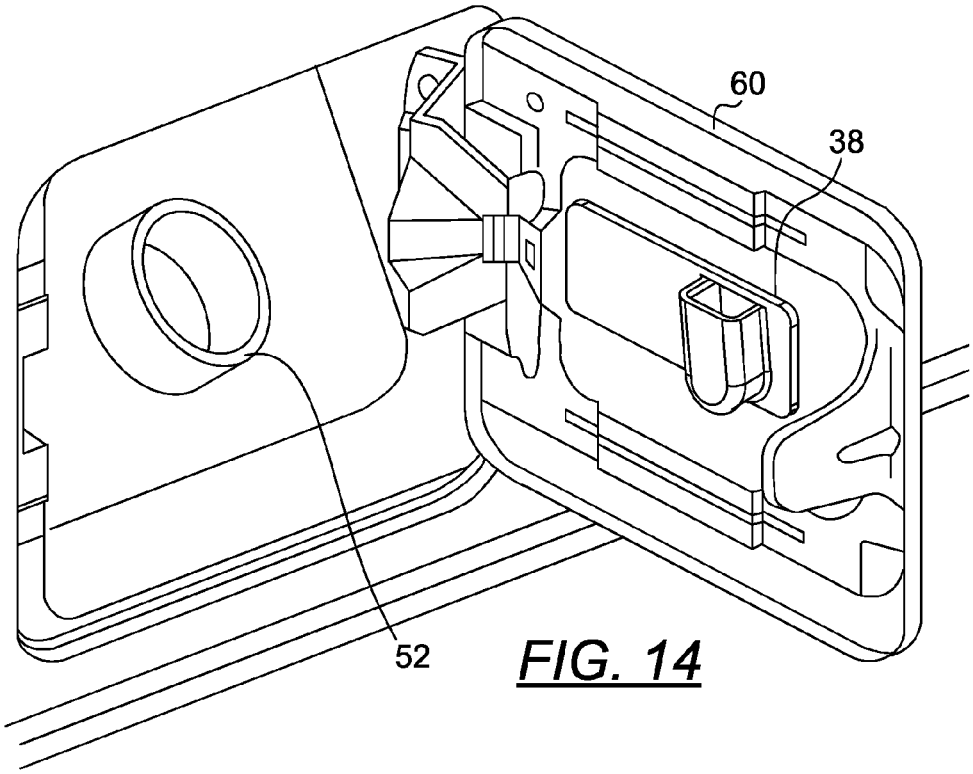
FIG. 14 is a top perspective view of a fuel filler door of a vehicle, depicting a holster attached to the fuel filler door.

FIG. 12 is a top perspective view of a holster configured for securing a present holder for the convenience of its user. FIG. 13 is a side orthogonal view of a present holder being secured in a holster 38. In one aspect, the holster 38 is configured for receiving the bottom prong 8 and adapted to be affixed to the vicinity of a fuel filler. The holster 38 includes a pocket 42 sized and shaped to receive the bottom prong 8 substantially in its entirety and a plate 40 configured as a backing material for attaching the holster 38 to a surface as shown in FIG. 14. FIG. 14 is a top perspective view of a fuel filler door of a vehicle depicting a holster 38 attached to the fuel filler door 60. A variety of attaching means are available to secure the holster 38 to the door 60, e.g., adhesive, fasteners, etc. The holder 2 may be alternatively be stored at a different location while not in use, such as on a key chain and the like. An aperture is preferably disposed in the protrusion 10 for such purpose.

Figure 15:
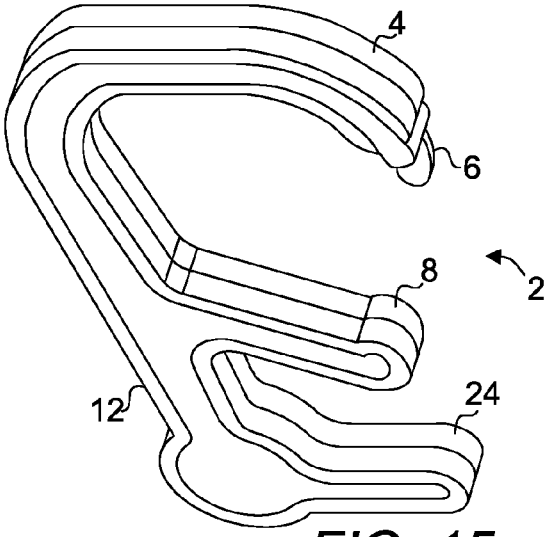
FIG. 15 is a top perspective view of yet another embodiment of the present holder.
Figure 16:
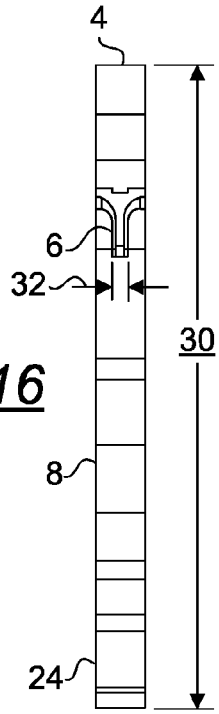
FIG. 16 is a front orthogonal view of the embodiment of FIG. 15.
Figure 17:
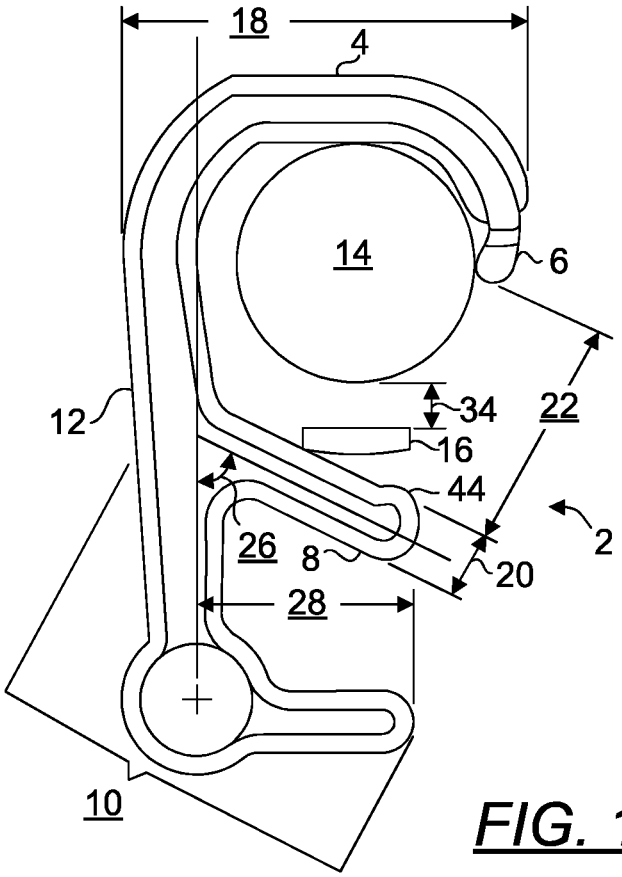
FIG. 17 is a side orthogonal view of the holder of FIG. 15, depicting its use on a fuel pump.

FIGS. 15 and 16 are top perspective and front orthogonal views, respectively, of yet another embodiment of the present holder. FIG. 17 is a side orthogonal view of the holder of FIG. 15, depicting its use on a fuel pump. In this embodiment, a blister 44 is disposed at the free end of the bottom prong 8. The blister is configured to cooperate with a surface on the bottom prong 8 which faces the top prong 4 to retain the trigger in a position corresponding to a fuel pump open position and release the trigger from such position by a previously described kicking motion. In certain types of fuel pump where the trigger may have a greater tendency to slide against the bottom prong 8, the blister 44 serves as a stop to prevent complete disengagement of the trigger 16 from the bottom prong 8 while refueling. In one embodiment, at least a portion of the blister 44 configured for contact with the trigger 16 is coated with a non-skid polymeric material to further enhance grip between the trigger 16 and the bottom prong 8.

The top and bottom prongs, base and protrusion of the present holder 2 are preferably fabricated as a single unit from petroleum resistant grade hard plastic while the surface of the bottom prong which comes in contact with a trigger while in use is preferably coated with a non-skid polymeric material.

We claim:

1. A fuel pump trigger holder for holding the trigger of a fuel pump in an open position, wherein the fuel pump includes a handle against which the trigger is squeezed to allow fuel flow, said fuel pump trigger holder comprising:

a pair of prongs comprising a top prong and a bottom prong, wherein said bottom prong extends from a first end of an elongated base and ends at a bottom endpoint, said top prong extends from a second end of said elongated base and ends at a top endpoint, said top prong includes a curved portion curving towards said bottom prong, said bottom prong includes an incline relative to said base, and said pair of prongs is configured for being disposed around the fuel pump trigger and the handle for maintaining the fuel pump trigger in a position corresponding to the open position and releasing the fuel pump trigger such that the fuel pump returns to a closed position upon detecting a kicking motion from the fuel pump indicating a full fuel condition.

2. The fuel pump trigger holder of claim 1, wherein said top prong further comprises an olecranon extending from said top endpoint.

3. The fuel pump trigger holder of claim 1, wherein said bottom prong comprises a ribbed surface disposed on a surface facing said top prong.

4. The fuel pump trigger holder of claim 1, further comprising a protrusion extending from said base in a direction away from said pair of prongs, wherein said protrusion is configured as a hand grip for said holder.

5. The fuel pump trigger holder of claim 1, wherein said incline is disposed at an angle of from about 69 degrees to about 85 degrees.

6. The fuel pump trigger holder of claim 1, further comprising a holster configured for receiving said bottom prong, wherein said holster is adapted to be affixed to the vicinity of a fuel filler adapted to receive the fuel pump.

7. The fuel pump trigger holder of claim 1, further comprising a blister disposed at said bottom endpoint, said blister is configured to cooperate with a surface of said bottom prong facing said top prong to retain the trigger in the open position and release the trigger such that the fuel pump returns to the closed position upon detecting the kicking motion from the fuel pump indicating the full fuel condition.

8. A fuel pump trigger holder for holding a fuel pump in an open position wherein the fuel pump has a handle and a trigger, and the open position corresponds to the trigger being pulled towards the handle, said fuel pump trigger holder comprising:

(a) an elongated base;

(b) a bottom prong extending from a first end of said base and at an incline with respect to said base to a bottom endpoint;

(c) a top prong extending from a second end of said base and terminating toward said bottom prong in a curved portion; and (d) an olecranon extending from said top prong to a top endpoint, wherein said olecranon and said bottom prong define an opening configured for limiting the distance between the trigger and the handle such that the fuel pump trigger is held in a position corresponding to an open position of the fuel pump and releasing the fuel pump trigger such that the fuel pump returns to a position corresponding to a closed position upon detecting a kicking motion from the fuel pump indicating a full fuel condition.

9. The fuel pump trigger holder of claim 8, wherein the distance between said top endpoint and bottom endpoint ranges from about 1.2 inches to about 1.4 inches.

10. The fuel pump trigger holder of claim 8, wherein said bottom prong comprises a ribbed surface disposed on a surface facing said top prong.

11. The fuel pump trigger holder of claim 8, further comprising a protrusion extending from said base in a direction away from said top and bottom prongs, wherein said protrusion is configured as hand grip for said holder.

12. The fuel pump trigger holder of claim 8, further comprising a holster configured for receiving said bottom prong, wherein said holster is adapted to be affixed to the vicinity of a fuel filler adapted to receive the fuel pump.

13. The fuel pump trigger holder of claim 8, further comprising a blister disposed at said bottom endpoint, said blister is configured to cooperate with a surface of said bottom prong facing said top prong to retain the trigger in an open position and release the trigger such that the fuel pump returns to the closed position upon detecting the kicking motion from the fuel pump indicating the full fuel condition.

14. A fuel pump trigger holder for holding a fuel pump including a handle and a trigger, in an open position which corresponds to the trigger being pulled towards the handle, said fuel pump trigger holder comprising:

(a) an elongated base;

(b) a bottom prong extending from a first end of said base and at an incline of from about 69 degrees to about 85 degrees with respect to said base to a bottom endpoint;

(c) a top prong extending from a second end of said base and terminating toward said bottom prong in a curved portion; and (d) an olecranon extending from said top prong to a top endpoint, wherein said olecranon and said bottom prong define an opening configured for limiting the distance between the trigger and the handle such that the fuel pump trigger is held in a position corresponding to an open position of the fuel pump and releasing the fuel pump trigger such that the fuel pump returns to a position corresponding to a closed position upon detecting a kicking motion from the fuel pump indicating a full fuel condition.

15. The fuel pump trigger holder of claim 14, wherein the distance between said top endpoint and bottom endpoint is about 1.4 inches.

16. The fuel pump trigger holder of claim 14, wherein said bottom prong comprises a ribbed surface disposed on a surface facing said top prong.

17. The fuel pump trigger holder of claim 14, further comprising a protrusion extending from said base in a direction away from said top and bottom prongs, wherein said protrusion is configured as hand grip for said holder.

18. The fuel pump trigger holder of claim 14, further comprising a holster configured for receiving said bottom prong, wherein said holster is adapted to be affixed to the vicinity of a fuel filler adapted to receive the fuel pump.

19. The fuel pump trigger holder of claim 14, further comprising a blister disposed at said bottom endpoint, said blister is configured to cooperate with a surface of said bottom prong facing said top prong to retain the trigger in an open position and release the trigger such that the fuel pump returns to the closed position upon detecting the kicking motion from the fuel pump indicating the full fuel condition.

* * * * *